US008245960B2

(12) United States Patent
Johnson et al.

(10) Patent No.: US 8,245,960 B2
(45) Date of Patent: Aug. 21, 2012

(54) AGITATION SYSTEM FOR BLOWING WOOL MACHINE

(75) Inventors: Michael W. Johnson, Lithopolis, OH (US); Michael E. Evans, Granville, OH (US); Agustin Hernandez, Blacklick, OH (US); Robert J. O'Leary, Newark, OH (US); Christopher M. Relyea, Columbus, OH (US); Brian K. Linstedt, Ostrander, OH (US); Gregory J. Merz, Gahanna, OH (US); Jeffrey W. Servaites, Centerville, OH (US); Keith A. Grider, Columbus, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 12/724,462

(22) Filed: Mar. 16, 2010

(65) Prior Publication Data

US 2010/0219274 A1 Sep. 2, 2010

Related U.S. Application Data

(62) Division of application No. 11/581,659, filed on Oct. 16, 2006, now Pat. No. 7,731,115.

(51) Int. Cl.
*B02C 23/20* (2006.01)

(52) U.S. Cl. ..... 241/60; 241/277; 241/101.8; 241/605

(58) Field of Classification Search ..... 241/60, 241/277, 605, 101.8, 235
See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,273,962 | A | 2/1942 | Hubbard |
| 2,291,871 | A | 8/1942 | Bokum et al. |
| 2,308,197 | A | 1/1943 | Meyer |
| 2,404,678 | A | 7/1946 | Wuensch |
| 2,550,354 | A | 4/1951 | Jacobsen |
| 2,721,767 | A | 10/1955 | Kropp |
| 2,754,995 | A | 7/1956 | Switzer |
| 2,794,454 | A | 6/1957 | Moulthrop |
| 2,869,793 | A | 1/1959 | Montgomery |
| 2,938,651 | A | 5/1960 | Specht et al. |
| 2,964,896 | A | 12/1960 | Finocchiaro |
| 2,984,872 | A | 5/1961 | France |
| 2,989,525 | A | 6/1961 | Babb |
| 3,076,659 | A | 2/1963 | Kremer, Jr. |

(Continued)

FOREIGN PATENT DOCUMENTS

| | | | |
|---|---|---|---|
| DE | 3238492 | A1 | 4/1984 |

(Continued)

*Primary Examiner* — Bena Miller
(74) *Attorney, Agent, or Firm* — MacMillan, Sobanski & Todd, LLC

(57) ABSTRACT

A machine for distributing blowing wool from a bag of compressed blowing wool is provided. The machine includes a shredding chamber configured to shred and pick apart the blowing wool. The shredding chamber includes a plurality of shredders and an agitator. The plurality of shredders and the agitator are configured for rotation. The plurality of shredders and the agitator are configured to rotate at different speeds.

9 Claims, 7 Drawing Sheets

U.S. PATENT DOCUMENTS 3,175,866 A 3/1965 Nichol
3,201,007 A 8/1965 Transeau
3,208,491 A * 9/1965 Bliss ..... 241/186.35
3,231,105 A 1/1966 Easley, Jr.
3,278,013 A 10/1966 Banks
3,399,931 A 9/1968 Vogt
3,403,942 A 10/1968 Farnworth
3,485,345 A 12/1969 Deasy
3,512,345 A 5/1970 Smith
3,556,355 A 1/1971 Rulz
3,591,444 A 7/1971 Hoppe
3,627,211 A * 12/1971 Leach ..... 241/3
3,747,743 A 7/1973 Hoffmann, Jr.
3,861,599 A 1/1975 Waggoner
3,869,337 A 3/1975 Hoppe et al.
3,895,745 A 7/1975 Hook
3,952,757 A 4/1976 Huey
4,059,205 A 11/1977 Heyl
4,129,338 A 12/1978 Mudgett
4,133,542 A 1/1979 Janian et al.
4,134,508 A 1/1979 Burdett, Jr.
4,155,486 A 5/1979 Brown
4,179,043 A 12/1979 Fischer
4,180,188 A 12/1979 Aonuma et al.
4,268,205 A 5/1981 Vacca et al.
4,337,902 A 7/1982 Markham
4,346,140 A 8/1982 Carlson et al.
4,381,082 A 4/1983 Elliott et al.
4,465,239 A * 8/1984 Woten ..... 241/98
4,536,121 A 8/1985 Stewart et al.
4,537,333 A 8/1985 Bjerregaard
4,585,239 A 4/1986 Nicholson
4,652,329 A 3/1987 Föcke
4,695,501 A 9/1987 Robinson
4,752,038 A * 6/1988 Takahashi et al. ..... 241/158
4,784,298 A 11/1988 Heep et al.
4,880,150 A 11/1989 Navin et al.
4,915,265 A 4/1990 Heep et al.
4,919,403 A 4/1990 Bartholomew
5,014,885 A 5/1991 Heep et al.
5,037,014 A 8/1991 Bliss
5,052,288 A 10/1991 Marquez et al.
5,110,059 A * 5/1992 Titmas et al. ..... 241/47
5,129,554 A 7/1992 Futamura
5,143,307 A * 9/1992 Lundquist ..... 241/60
5,166,236 A 11/1992 Alexander et al.
5,285,973 A * 2/1994 Goforth et al. ..... 241/36
5,289,982 A 3/1994 Anderson
5,303,672 A 4/1994 Morris
5,368,311 A 11/1994 Heyl
5,392,964 A 2/1995 Stapp et al.
5,405,231 A 4/1995 Kronberg
5,472,305 A 12/1995 Ikeda et al.
5,516,499 A 5/1996 Pereira et al.
5,562,255 A * 10/1996 Witko et al. ..... 241/158
5,573,190 A * 11/1996 Goossen ..... 241/27
5,601,239 A 2/1997 Smith et al.
5,620,116 A 4/1997 Kluger et al.
5,624,742 A 4/1997 Babbitt et al.
5,642,601 A 7/1997 Thompson, Jr. et al.
5,647,696 A 7/1997 Sperber
5,819,991 A 10/1998 Kohn et al.
5,860,232 A 1/1999 Nathenson et al.
5,860,606 A 1/1999 Tiedeman et al.
5,927,558 A 7/1999 Bruce
5,927,627 A * 7/1999 Edson et al. ..... 241/159
5,934,809 A 8/1999 Marbler
5,997,220 A 12/1999 Wormser
6,004,023 A 12/1999 Koyanagi et al.
6,036,060 A 3/2000 Münsch et al.
6,161,784 A 12/2000 Horton
6,266,843 B1 7/2001 Doman et al.
6,510,945 B1 1/2003 Allwein et al.
6,698,458 B1 3/2004 Sollars, Jr. et al.
6,779,691 B2 8/2004 Cheng
6,783,154 B2 8/2004 Persson et al.
6,820,542 B1 * 11/2004 Truitt ..... 100/3
6,826,991 B1 12/2004 Rasmussen
7,036,757 B2 * 5/2006 Kisenwether ..... 241/186.35
7,284,715 B2 10/2007 Dziesinski et al.
7,354,466 B2 4/2008 Dunning et al.
7,588,206 B2 * 9/2009 Hausman et al. ..... 241/235
2001/0036411 A1 11/2001 Walker
2003/0075629 A1 4/2003 Lucas et al.
2003/0192589 A1 10/2003 Jennings
2003/0215165 A1 11/2003 Hogan et al.
2003/0234264 A1 12/2003 Landau
2005/0006508 A1 1/2005 Roberts
2005/0242221 A1 11/2005 Rota
2006/0231651 A1 10/2006 Evans et al.
2007/0138211 A1 6/2007 O'Leary et al.
2008/0087751 A1 4/2008 Johnson et al.

FOREIGN PATENT DOCUMENTS

DE 3240126 A1 5/1984
EP 0265751 A1 5/1988
FR 2350450 A1 12/1977
GB 1418882 A 12/1975
GB 1574027 A 9/1980
GB 2124194 A 2/1984
GB 2156303 A 10/1985
GB 2212471 A 7/1989
GB 2276147 A 9/1994

* cited by examiner

AGITATION SYSTEM FOR BLOWING WOOL MACHINE

RELATED APPLICATIONS

This application is a divisional patent application of pending U.S. patent application Ser. No. 11/581,659, filed Oct. 16, 2006, the disclosure of which is incorporated herein by reference.

TECHNICAL FIELD

This invention relates to loosefil insulation for insulating buildings. More particularly this invention relates to machines for distributing packaged loosefil insulation.

BACKGROUND OF THE INVENTION

In the insulation of buildings, a frequently used insulation product is loosefil insulation. In contrast to the unitary or monolithic structure of insulation batts or blankets, loosefil insulation is a multiplicity of discrete, individual tufts, cubes, flakes or nodules. Loosefil insulation is usually applied to buildings by blowing the insulation into an insulation cavity, such as a wall cavity or an attic of a building. Typically loosefil insulation is made of glass fibers although other mineral fibers, organic fibers, and cellulose fibers can be used.

Loosefil insulation, commonly referred to as blowing wool, is typically compressed in packages for transport from an insulation manufacturing site to a building that is to be insulated. Typically the packages include compressed blowing wool encapsulated in a bag. The bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the package is opened and the blowing wool is allowed to expand.

It would be advantageous if blowing wool machines could be improved to make them easier to use.

SUMMARY OF THE INVENTION

The above objects as well as other objects not specifically enumerated are achieved by a machine for distributing blowing wool from a bag of compressed blowing wool. The machine includes a shredding chamber configured to shred and pick apart the blowing wool. The shredding chamber includes a plurality of shredders and an agitator. The plurality of shredders and the agitator are configured for rotation. The plurality of shredders and the agitator are configured to rotate at different speeds.

According to this invention there is also provided a machine for distributing blowing wool from a bag of compressed blowing wool. The machine includes a chute having an inlet end, the inlet end configured to receive the bag of compressed blowing wool. A shredding chamber is associated with the chute and is configured to shred and pick apart the blowing wool. The shredding chamber includes a plurality of shredders, each shredder having a plurality of paddle assemblies mounted for rotation on a shredder shaft in a manner such that paddle assemblies on one shredder shaft correspond to paddle assemblies on an adjacent shredder shaft. The plurality of paddle assemblies on the one shredder shaft each having a major axis and the corresponding paddle assemblies on the adjacent shredder shaft each having a major axis. The plurality of paddle assemblies are arranged such that the major axes of the corresponding paddle assemblies have an indexed arrangement.

According to this invention there is also provided a machine for distributing blowing wool from a bag of compressed blowing wool. The machine includes a chute having an inlet end, the inlet end configured to receive the bag of compressed blowing wool. A shredding chamber is associated with the chute and configured to shred and pick apart the blowing wool. The shredding chamber includes a plurality of shredders configured for rotation. Each shredder includes a plurality of paddle assemblies mounted to a shredder shaft. Each paddle assembly includes a plurality of paddles. The paddles are mounted to form an acute angle relative to a major axis of the shredder shafts.

According to this invention there is also provided a machine for distributing blowing wool from a bag of compressed blowing wool. The machine includes a chute having an inlet end, the inlet end configured to receive the bag of compressed blowing wool. A shredding chamber is positioned downstream from the chute and configured to shred and pick apart the blowing wool. The shredding chamber includes a plurality of shredders configured for rotation. Each shredder includes a plurality of paddle assemblies mounted to a shredder shaft. The paddle assemblies have paddles. The paddles have a hardness within the range of 60 A to 70 A Durometer to better grip the blowing wool and prevent jamming of the blowing wool within the shredder.

According to this invention there is also provided a machine for distributing blowing wool from a bag of compressed blowing wool. The machine includes a chute having an inlet end, the inlet end configured to receive the bag of compressed blowing wool, a shredding chamber is associated with the chute and includes a plurality of shredders configured to shred and pick apart the blowing wool. The shredders are interchangeable.

Various objects and advantages of this invention will become apparent to those skilled in the art from the following detailed description of the preferred embodiment, when read in light of the accompanying drawings.

DETAILED DESCRIPTION OF THE INVENTION

Figure 1:
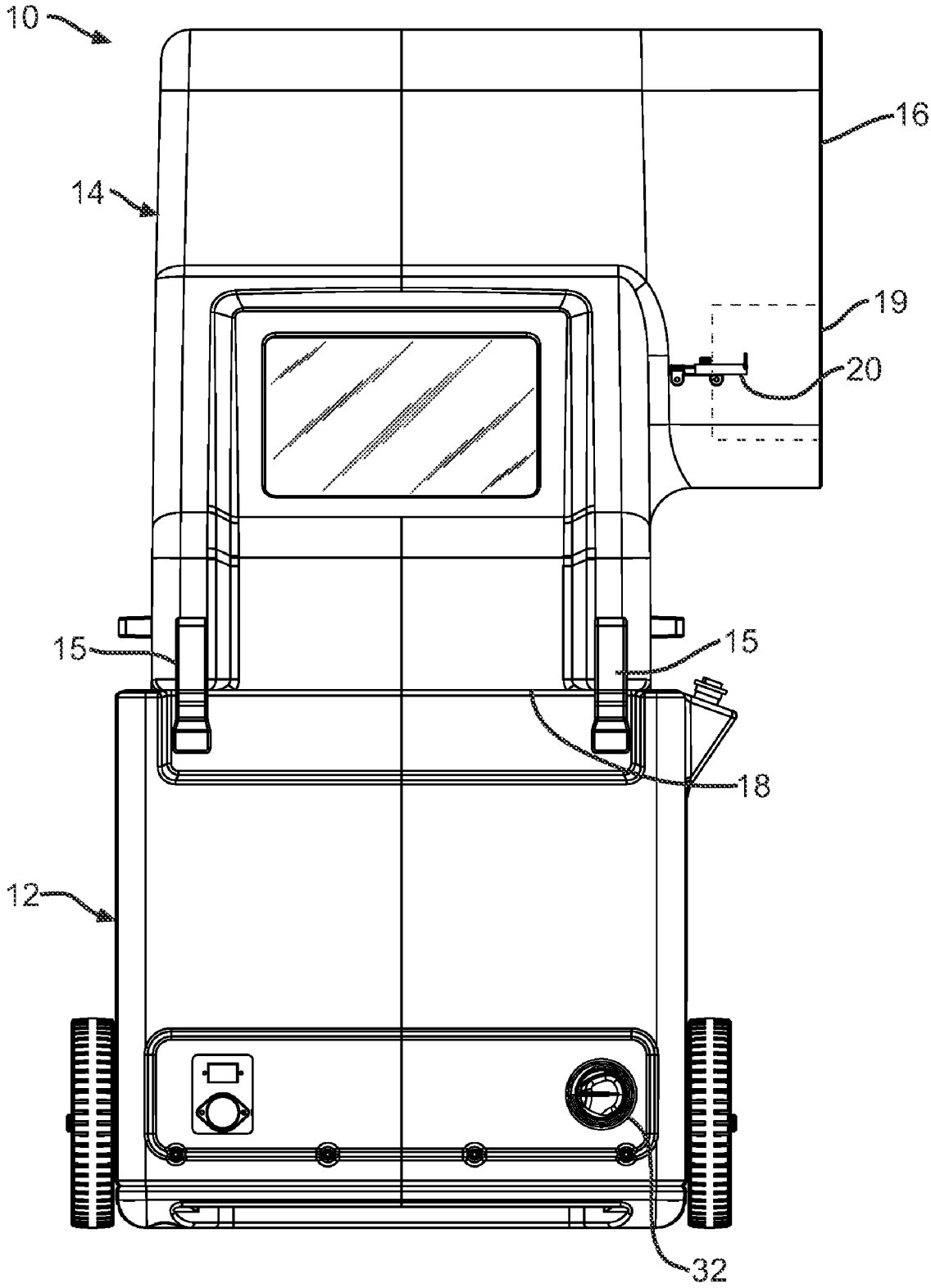
FIG. 1 is a front view in elevation of an insulation blowing wool machine.
Figure 2:
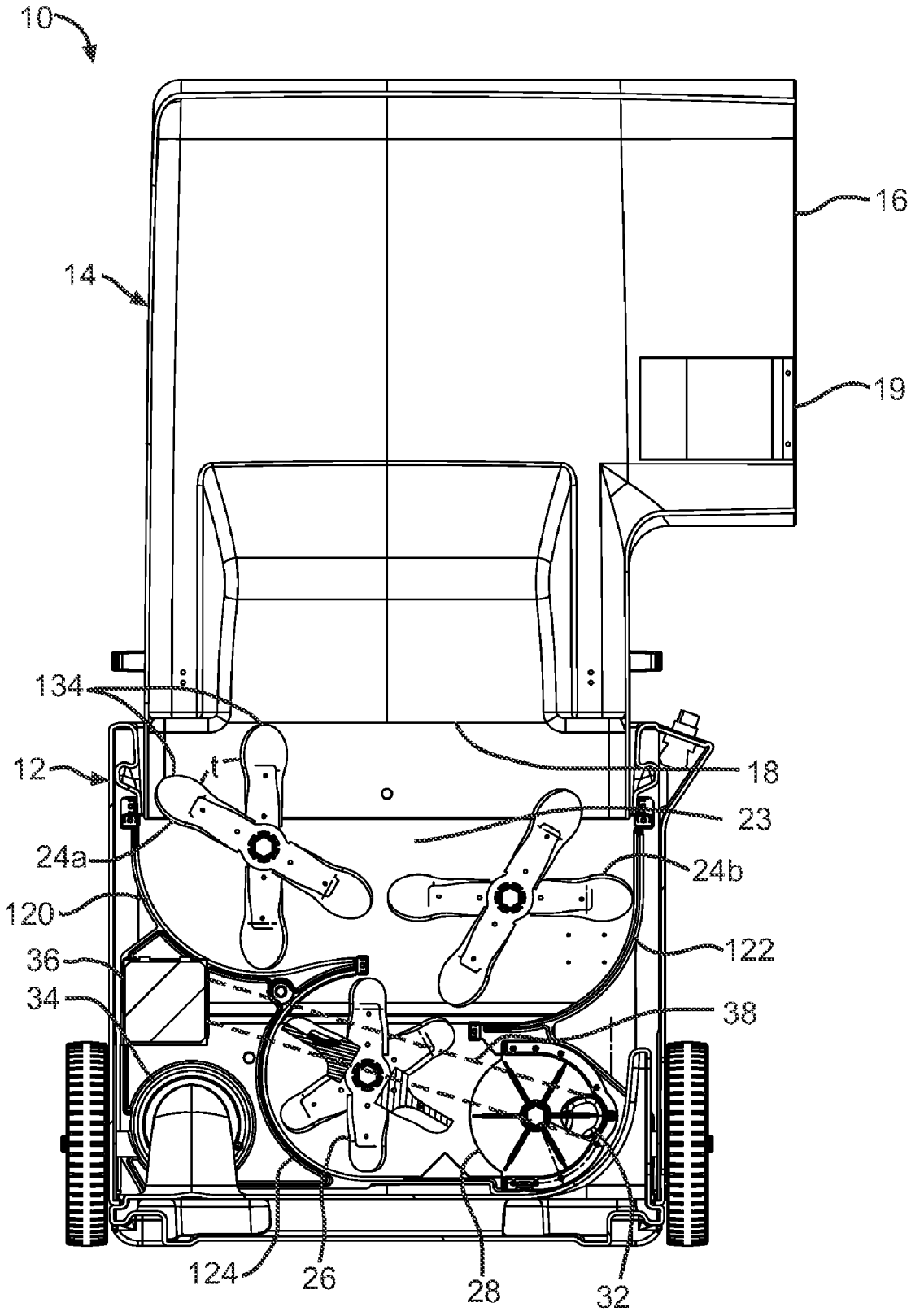
FIG. 2 is a front view in elevation, partially in cross-section, of the insulation blowing wool machine of FIG. 1.
Figure 3:
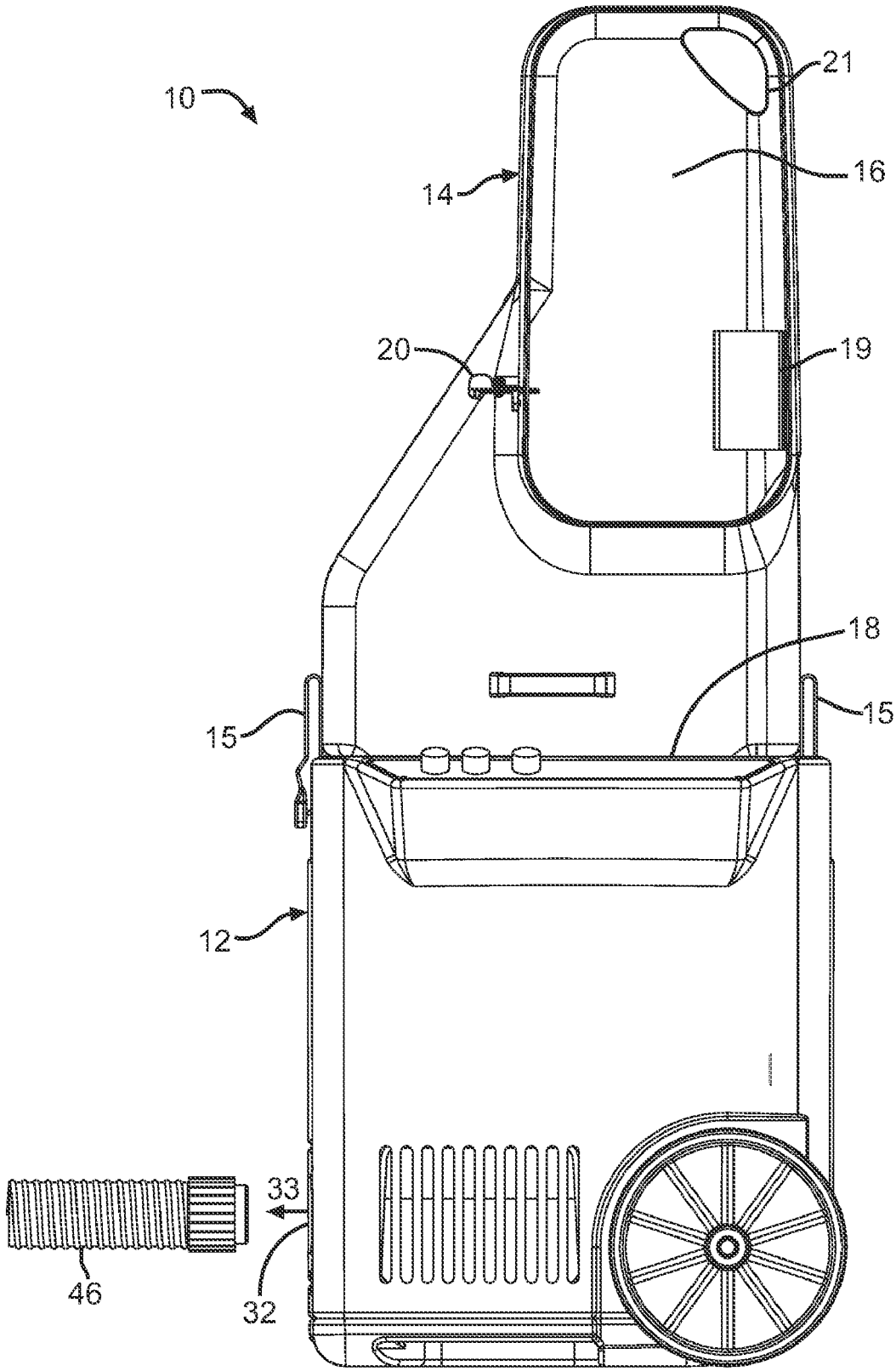
FIG. 3 is a side view in elevation of the insulation blowing wool machine of FIG. 1.

A blowing wool machine 10 for distributing compressed blowing wool is shown in FIGS. 1-3. The blowing wool machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing wool and introduce the blowing wool to the shredding chamber 23 as shown in FIG. 2. Optionally, the chute 14 includes a handle segment 21, as shown in FIG. 3, to facilitate easy movement of the blowing wool machine 10 from one location to another. However, the handle segment 21 is not necessary to the operation of the machine 10.

As further shown in FIGS. 1-3, the chute 14 includes an optional guide assembly 19 mounted at the inlet end 16 of the chute 14. The guide assembly 19 is configured to urge a package of compressed blowing wool against a cutting mechanism 20, as shown in FIGS. 1 and 3, as the package moves into the chute 14.

As shown in FIG. 2, the shredding chamber 23 is mounted at the outlet end 18 of the chute 14. In this embodiment, the shredding chamber 23 includes a plurality of low speed shredders 24*a* and 24*b* and an agitator 26. The low speed shredders 24*a* and 24*b* shred and pick apart the blowing wool as the blowing wool is discharged from the outlet end 18 of the chute 14 into the lower unit 12. Although the blowing wool machine 10 is shown with a plurality of low speed shredders 24, any type of separator, such as a clump breaker, beater bar or any other mechanism that shreds and picks apart the blowing wool can be used.

As further shown in FIG. 2, the shredding chamber 23 includes an agitator 26 for final shredding of the blowing wool and for preparing the blowing wool for distribution into an airstream. In this embodiment as shown in FIG. 2, the agitator 26 is beneath the low speed shredders 24*a* and 24*b*. Alternatively, the agitator 26 can be disposed in any location relative to the low speed shredders 24*a* and 24*b*, such as horizontally adjacent to the shredders 24*a* and 24*b*, sufficient to receive the blowing wool from the low speed shredders 24*a* and 24*b*. In this embodiment, the agitator 26 is a high speed shredder. Alternatively, any type of shredder can be used, such as a low speed shredder, clump breaker, beater bar or any other mechanism that finely shreds the blowing wool and prepares the blowing wool for distribution into an airstream.

In this embodiment, the low speed shredders 24*a* and 24*b* rotate at a lower speed than the agitator 26. The low speed shredders 24*a* and 24*b* rotate at a speed of about 40-80 rpm and the agitator 26 rotates at a speed of about 300-500 rpm. In another embodiment, the low speed shredders 24*a* and 24*b* can rotate at a speed less than or more than 40-80 rpm, provided the speed is sufficient to shred and pick apart the blowing wool. The agitator 26 can rotate at a speed less than or more than 300-500 rpm provided the speed is sufficient to finely shred the blowing wool and prepare the blowing wool for distribution into the airstream 33.

Referring again to FIG. 2, a discharge mechanism 28 is positioned adjacent to the agitator 26 and is configured to distribute the finely shredded blowing wool into the airstream. In this embodiment, the shredded blowing wool is driven through the discharge mechanism 28 and through a machine outlet 32 by an airstream provided by a blower 36 mounted in the lower unit 12. The airstream is indicated by an arrow 33 as shown in FIG. 3. In another embodiment, the airstream 33 can be provided by another method, such as by a vacuum, sufficient to provide an airstream 33 driven through the discharge mechanism 28. In this embodiment, the blower 36 provides the airstream 33 to the discharge mechanism 28 through a duct 38, shown in phantom in FIG. 2 from the blower 36 to the rotary valve 28. Alternatively, the airstream 33 can be provided to the discharge mechanism 28 by another structure, such as a hose or pipe, sufficient to provide the discharge mechanism 28 with the airstream 33.

The shredders 24*a* and 24*b*, agitator 26, discharge mechanism 28 and the blower 36 are mounted for rotation. They can be driven by any suitable means, such as by a motor 34, or any other means sufficient to drive rotary equipment. Alternatively, each of the shredders 24*a* and 24*b*, agitator 26, discharge mechanism 28 and blower 36 can be provided with its own motor.

In operation, the chute 14 guides the blowing wool to the shredding chamber 23. The shredding chamber 23 includes the low speed shredders 24*a* and 24*b* which shred and pick apart the blowing wool. The shredded blowing wool drops from the low speed shredders 24*a* and 24*b* into the agitator 26. The agitator 26 prepares the blowing wool for distribution into the airstream 33 by further shredding the blowing wool. The finely shredded blowing wool exits the agitator 26 and enters the discharge mechanism 28 for distribution into the airstream 33 caused by the blower 36. The airstream 33, with the shredded blowing wool, exits the machine 10 at the machine outlet 32 and flows through the distribution hose 46, as shown in FIG. 3, toward the insulation cavity, not shown.

Figure 4:
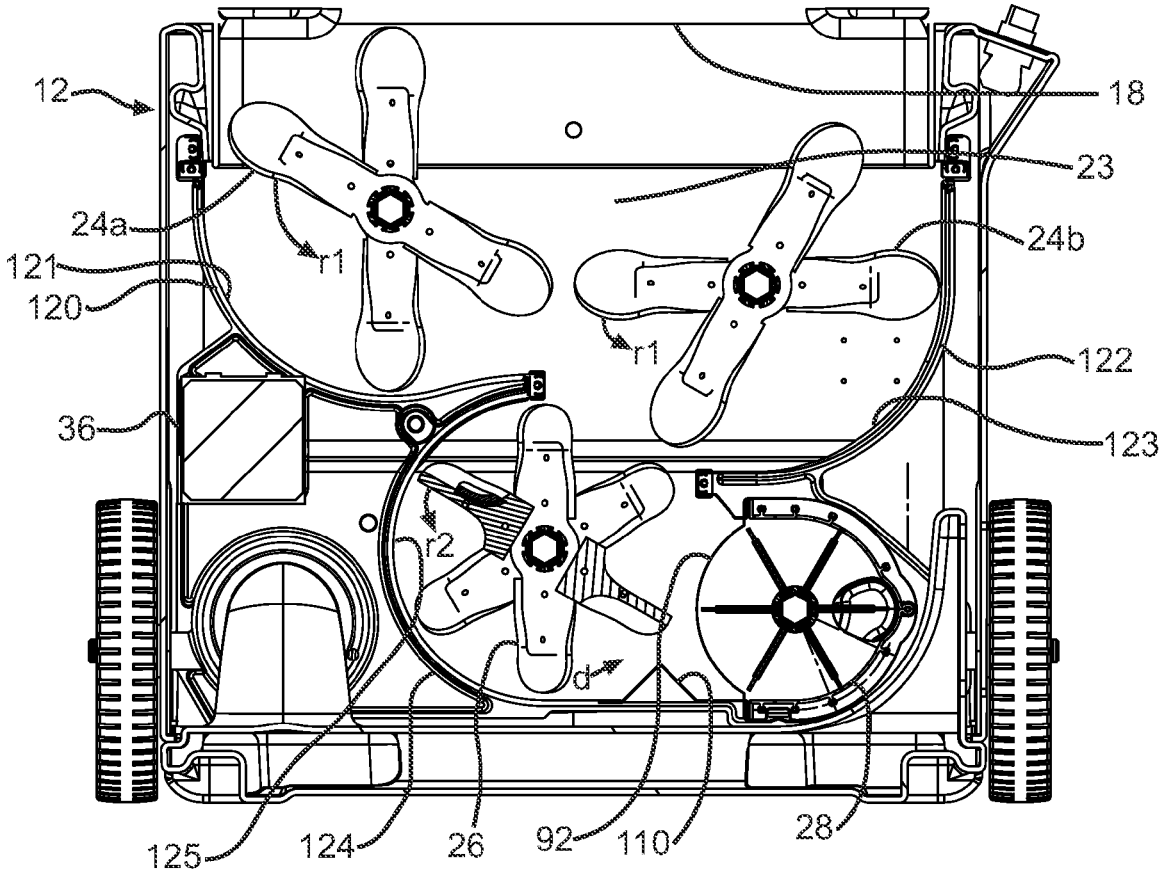
FIG. 4 is a front view, partially in cross-section, of the lower unit of the insulation blowing wool machine of FIG. 1.

As previously discussed and as shown in FIG. 4, the discharge mechanism 28 is configured to distribute the finely shredded blowing wool into the airstream 33. In this embodiment, the discharge mechanism 28 is a rotary valve. Alternatively, the discharge mechanism 28 can be any other mechanism including staging hoppers, metering devices, or rotary feeders, sufficient to distribute the shredded blowing wool into the airstream 33.

In this embodiment as further shown in FIG. 4, the low speed shredders 24*a* and 24*b* rotate in a counter-clockwise direction r1 and the agitator 26 rotates in a counter-clockwise direction r2. Rotating the low speed shredders 24*a* and 24*b* and the agitator 26 in the same counter-clockwise direction allows the low speed shredders 24*a* and 24*b* and the agitator 26 to shred and pick apart the blowing wool while substantially preventing an accumulation of unshredded or partially shredded blowing wool in the shredding chamber 23. In another embodiment, the low speed shredders 24*a* and 24*b* and the agitator 26 each could rotate in a clock-wise direction or the low speed shredders 24*a* and 24*b* and the agitator 26 could rotate in different directions provided the relative rotational directions allow finely shredded blowing wool to be fed into the discharge mechanism 28 while preventing a substantial accumulation of unshredded or partially shredded blowing wool in the shredding chamber 23.

In this embodiment as shown FIG. 4, the shredding chamber 23 includes a plurality of guide shells 120, 122 and 124. The upper left guide shell 120 is positioned partially around the low speed shredder 24*a* and extends to form an arc of approximately 90°. The upper left guide shell 120 has an upper left guide shell inner surface 121. The upper left guide shell 120 is configured to allow the low speed shredder 24*a* to seal against the upper left guide shell surface 121 and thereby direct the blowing wool in a downstream direction as the low speed shredder 24*a* rotates.

In a similar manner as the upper left guide shell 120, the upper right guide shell 122 is positioned partially around the low speed shredder 24*b* and extends to form an arc of approximately 90°. The upper right guide shell 122 has an upper right guide shell inner surface 123. The upper right guide shell 122 is configured to allow the low speed shredder 24*b* to seal against the upper right guide shell inner surface 123 and thereby direct the blowing wool in a downstream direction as the low speed shredder 24*b* rotates.

In a manner similar to the upper guide shells 120 and 122, the lower guide shell 124 is positioned partially around the agitator 26 and extends to form an approximate semi-circle. The lower guide shell 124 has a lower guide shell inner surface 125. The lower guide shell 124 is configured to allow the agitator 26 to seal against the lower guide shell inner surface 125 and thereby direct the blowing wool in a downstream direction as the agitator 26 rotates.

In this embodiment, the upper guide shell inner surfaces 121 and 123, and the lower guide shell inner surface 125 are made of high density polyethylene (hdpe) configured to provide a lightweight, low friction guide for the blowing wool. Alternatively, the upper guide shell inner surfaces 121 and 123, and the lower guide shell inner surface 125 can be made of other materials, such as aluminum, sufficient to provide a sealing surface that allows the low speed shredders 24*a*, 24*b* or the agitator 26 to direct the blowing wool downstream.

In this embodiment, the upper guide shells 120 and 122 are curved and extend to form an arc of approximately 90°. In another embodiment, the upper guide shells 120 and 122 may be curved and extend to form an arc which is more or less than 90°, such that the upper guide shells 120 and 122 are sufficient to allow the low speed shredders 24*a* and 24*b* to seal against the upper guide shell surfaces 121 and 123, thereby directing the blowing wool in a downstream direction as the low speed shredders 24*a* and 24*b* rotate. Similarly in this embodiment, the lower guide shell 124 is curved and extends to form an approximate semi-circle. In another embodiment, the lower guide shell 124 may be curved and extend to form an arc which is more or less than a semi-circle, such that the lower guide shell 124 is sufficient to allow the agitator 26 to seal against the lower guide shell surface 125, thereby directing the blowing wool in a downstream direction as the agitator 26 rotates.

Figure 5:
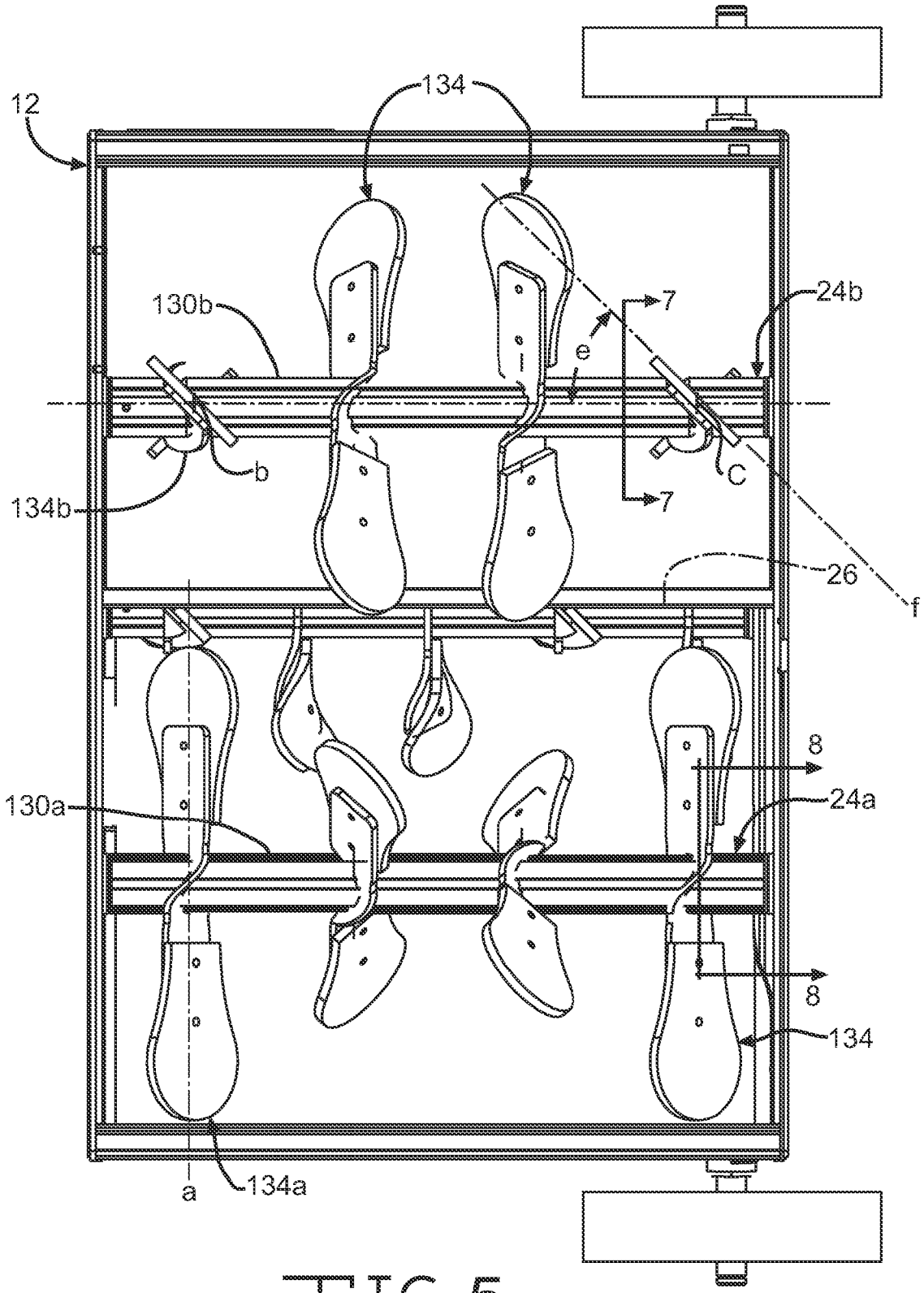
FIG. 5 is a plan view in elevation, of the shredding chamber of the insulation blowing wool machine of FIG. 1.

As previously discussed and as shown in FIG. 2, the shredding chamber 23 includes a plurality of low speed shredders 24*a* and 24*b* and an agitator 26. As shown in FIG. 5, the low speed shredders 24*a* and 24*b* include adjacent, parallel shredder shafts 130*a* and 130*b*, respectively. The shredder shafts 130*a* and 130*b* are configured to rotate within the shredding chamber 23 and are fitted with a plurality of paddle assemblies 134. In this embodiment, the shredder shafts 130*a* and 130*b* are made of steel, although the shredder shafts 130*a* and 130*b* can be made of other materials, including aluminum or plastic, sufficient to rotate within the shredding chamber 23 and to be fitted with paddle assemblies 134. In this embodiment as shown in FIG. 5, the low speed shredders 24*a* and 24*b* each have four paddle assemblies 134 extending perpendicular from the shredder shafts 130*a* and 130*b*. In another embodiment, the low speed shredder shafts 130*a* and 130*b* each can have more than four paddle assemblies 134 or any number of paddle assemblies 134 sufficient to shred and pick apart the blowing wool.

As further shown in FIG. 5, low speed shredder shaft 130*a* has a first paddle assembly 134*a* and adjacent low speed shredder shaft 130*b* has a second paddle assembly 134*b*. The first paddle assembly 134*a* has a major axis a extending along the length of the first paddle assembly 134*a*. Similarly, the second paddle assembly 134*b* has a major axis b extending along the length of the second paddle assembly 134*b*. In this embodiment, the major axis a of the first paddle assembly 134*a* is substantially perpendicular to the major axis b of the second paddle assembly 134*b*. The first paddle assembly 134*a* and the second paddle assembly 134*b* correspond to each other since they rotate in the same vertical plane. Similarly, the remaining paddle assemblies 134 disposed on the low speed shredder shaft 130*a* have major axis that are substantially perpendicularly positioned relative to the major axis of their corresponding paddle assemblies 134 disposed on the low speed shredder shaft 130*b*. The perpendicular alignment of the corresponding paddle assemblies 134*a* and 134*b* allows the low speed shredders 24*a* and 24*b* to effectively shred and pick apart the blowing wool and prevent heavy clumps of blowing wool from moving past the shredders 24*a* and 24*b* into the agitator 26 thereby preventing an accumulation of blowing wool. It can be seen that paddle assembly 134*a* on low speed shredder shaft 130*a* and its corresponding paddle assembly 134*b* on the adjacent low speed shredder shaft 130*b* have an indexed arrangement such that they do not interfere with each other and provide better shredding as they rotate.

Figure 7:
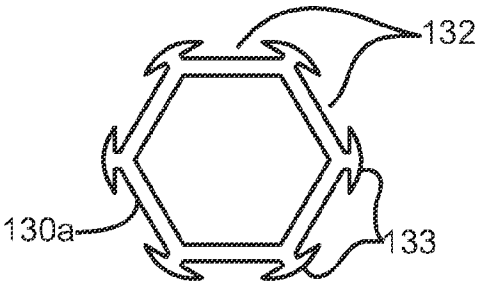
FIG. 7 is a front view in cross-section of the low speed shredder shaft of FIG. 5, taken along line 7-7.
Figure 8:
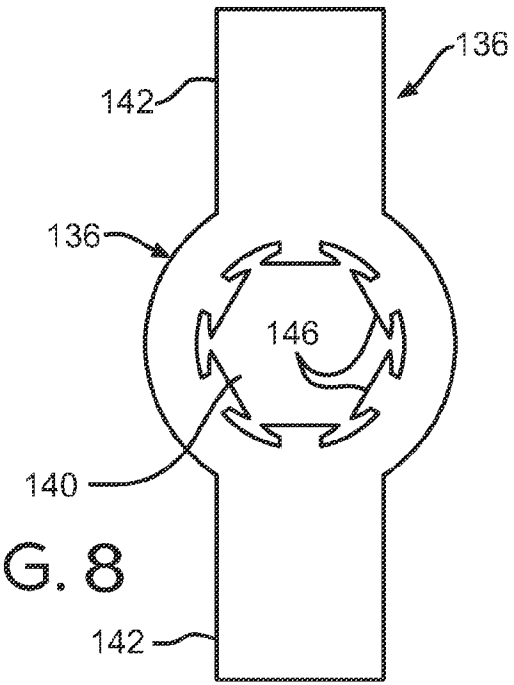
FIG. 8 is a front view in cross-section of the blade of the low speed shredder of FIG. 5, taken along line 8-8.
Figure 6:
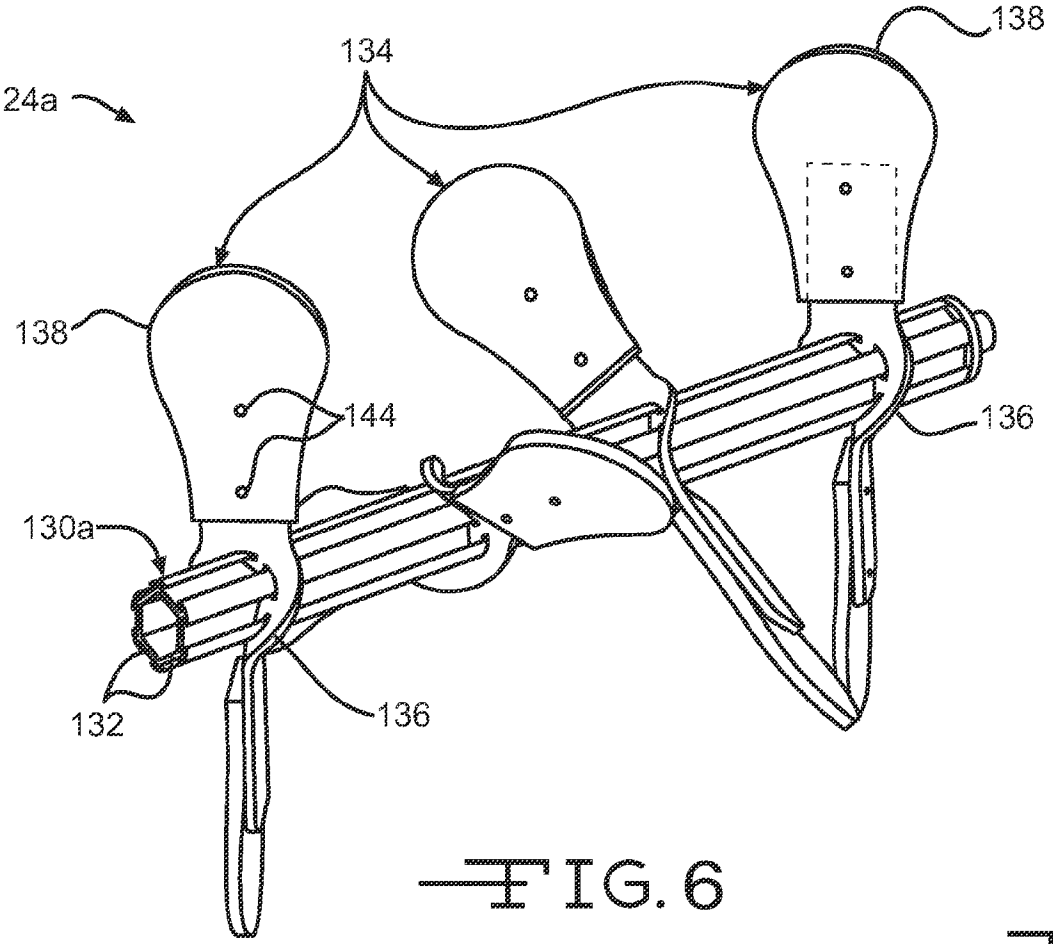
FIG. 6 is a perspective view of a low speed shredder of the insulation blowing wool machine of FIG. 1.

As previously discussed and as shown in FIG. 6, the low speed shredders 24*a* and 24*b* include shredder shafts 130*a* and 130*b* and a plurality of paddle assemblies 134. As best shown in FIG. 7, the shredder shafts 130*a* and 130*b* are hollow rods having a plurality of flat faces 132 and alternate tangs 133 extending substantially along the length of the shredder shafts 130*a* and 130*b*. Referring again to FIG. 6, each paddle assembly 134 includes a blade 136 and two paddles 138. In this embodiment as shown in FIG. 8, the blade 136 is a flat member with a hole 140 and two mounting arms 142. The paddles 138 are fastened to the mounting arms 142 by rivets 144 as shown in FIG. 6. Alternatively, the paddles 138 can be fastened to the mounting arms 142 by other fastening methods including adhesive, clips, clamps, or by other fastening methods sufficient to attach the paddles 138 to the mounting arms 142. The blades 136 include T-shaped projections 146 positioned within the hole 140. In this embodiment as shown in FIG. 8, each paddle assembly 134 includes a blade 136 having two mounting arms 142 suitable for attaching the paddles 138. In another embodiment, each paddle assembly 134 can include more or less than two mounting arms 142, each having a paddle 138 attached to the mounting arm 142, such that the paddle assemblies 134 effectively shred and pick apart the blowing wool.

The blades 136 and the paddles 138 are mounted to the shredder shafts 130*a* and 130*b* by sliding the T-shaped projections 146 of the blades 136 onto the flat faces 132 of the shredder shafts 130*a* and 130*b*. The paddle assemblies 134, made up of the blades 136 and the paddles 138 and positioned on the shredder shafts 130*a* and 130*b*, have a major axis c which is substantially perpendicular to the shredder shafts 130*a* and 130*b* as shown in FIG. 5. Once the blades 136 and the paddles are positioned in the desired location along the shredder shafts 130*a* and 130*b*, the mounting arms 142 of the blades 136 are twisted, such that the T-shaped projections 146 of the blades 136 deform within the alternate tangs 133 of the shredder shafts 130*a* and 130*b* thereby locking the blades 136 and the paddles 138 in position.

As further shown in FIG. 5, the twisted blades 136 and paddles 138 form an axis f. The axis f forms an acute angle e relative to a major axis of the shredder shaft 130*b*. In this embodiment, acute angle e is approximately 40°-50°. By having acute angle e at approximately 40°-50°, the blades 136 and paddles 138 efficiently shred and pick apart the blowing wool. While in this embodiment, the acute angle e is approximately 40°-50°, in another embodiment, the acute angle e may be more than 40°-50° or less than 40°-50° provided that the paddle assemblies 134 can efficiently shred and pick apart the blowing wool.

As previously discussed and as shown in FIG. 5, the low speed shredders 24*a* and 24*b* include paddle assemblies 134, each paddle assembly having a plurality of paddles 138. In this embodiment, the paddles 138 are made of rubber and have a hardness rating of 60 A to 70 A Durometer. A hardness rating of between 60 A to 70 A allows the paddles 138 to effectively grip the blowing wool for shredding while preventing jamming of the blowing wool in the shredders 24*a* and 24*b*. Optionally, the paddles 138 can have a hardness greater than 70 A or less than 60 A. In another embodiment, the paddles 138 can be made of other materials, such as aluminum or plastic, sufficient to effectively grip the blowing wool for shredding while preventing jamming of blowing wool in the shredders 24*a* and 24*b*.

As further shown in FIG. 5, the low speed shredders 24*a* and 24*b* include a plurality of paddle assemblies 134 mounted to shredder shafts 130*a* and 130*b*. The plurality of paddle assemblies 134 are mounted on each shredder shaft 130*a* and 130*b* such that adjacent paddle assemblies 134 on the same shredder shaft 130*a* or 130*b* are offset from each other by an angle t as best shown in FIG. 2. Offsetting the paddle assemblies 134, from each other, on the shredder shafts 130*a* and 130*b* allows the paddle assemblies 134 to effectively grip the blowing wool for shredding while preventing jamming of the blowing wool in the shredders 24*a* and 24*b*. In this embodiment as shown in FIG. 2, the adjacent paddle assemblies 134 are offset by an angle t of approximately 60°. In another embodiment, the angle of offset can be any angle, such as an angle t within the range of from about 45° to about 90°, sufficient to effectively grip the blowing wool for shredding while preventing jamming of the blowing wool in the shredders 24*a* and 24*b*.

As discussed above and shown in FIG. 5, the low speed shredders 24*a* and 24*b* include a plurality of paddle assemblies 134 mounted to shredder shafts 130*a* and 130*b*. In this embodiment, the shredder shafts 130*a* and 130*b* are substantially physically identical. Similarly, the paddle assemblies 134 mounted to the shredder shafts 130*a* and 130*b* are substantially physically identical and mounted to the respective shredder shafts 130*a* and 130*b* in the same manner. The shredders 24*a* and 24*b* are assembled to be identical for ease of replacement and also to be interchangeable. The term "interchangeable", as used herein, is defined to mean that shredder 24*a* can be replaced with shredder 24*b* and vice versa. It is to be understood that the shredder shafts 130*a* and 130*b* can be different. Similarly, in another embodiment, the shredders 24*a* and 24*b* can be different.

Figure 9:
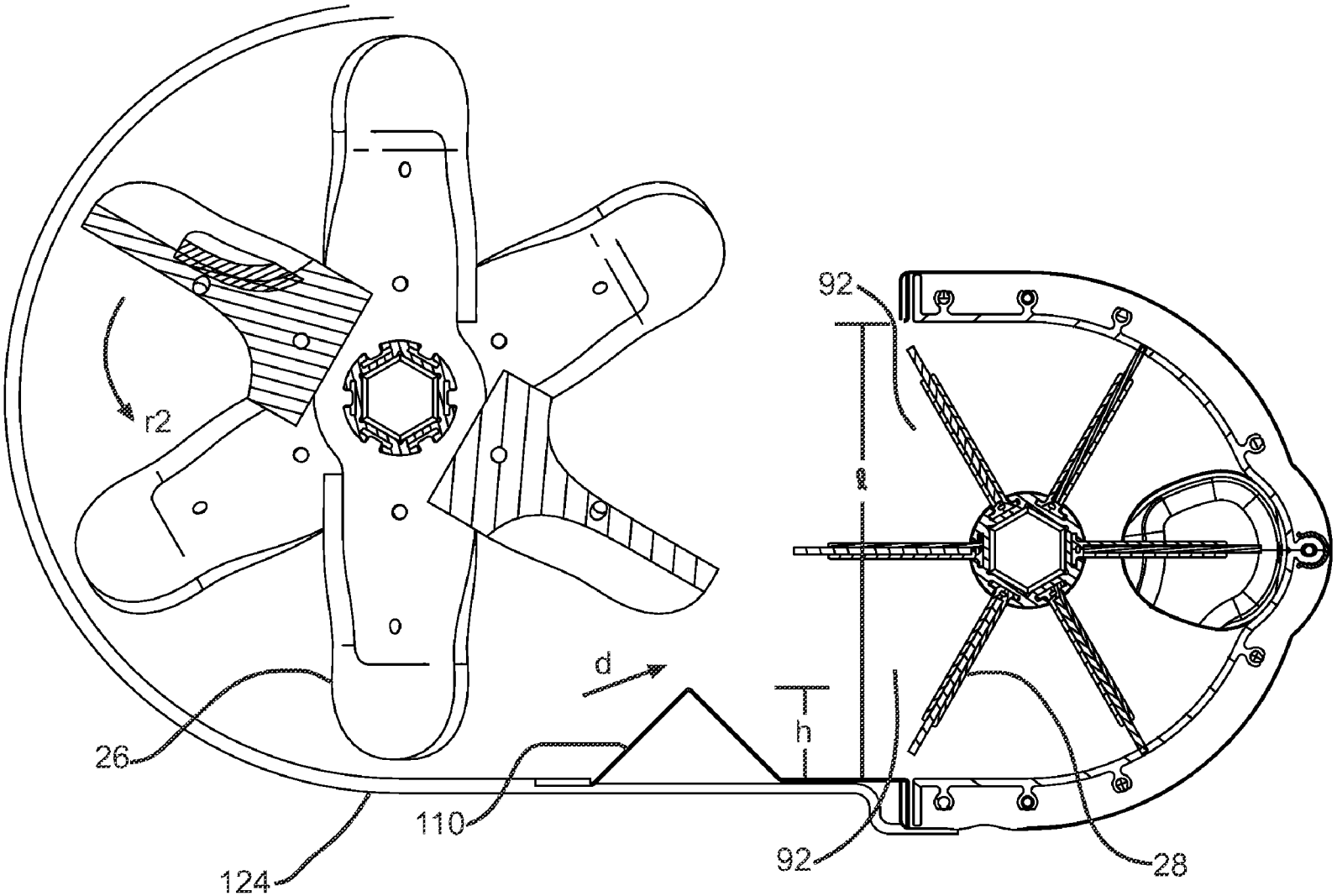
FIG. 9 is a front view in elevation of the agitator, side inlet and discharge mechanism of the insulation blowing machine of FIG. 1.

As previously discussed and as shown in FIGS. 4 and 9, the shredded blowing wool exits the low speed shredders 24*a* and 24*b* and drops into the agitator 26 for final shredding. In this embodiment as best shown in FIG. 9, the agitator 26 rotates in a counter-clockwise direction r2 and forces the finely shredded blowing wool in direction d toward a side inlet 92 of the discharge mechanism 28 for distribution into the airstream 33. A baffle 110 is positioned between the agitator 26 and the side inlet 92 of the discharge mechanism 28. The baffle 110 can be molded into the lower guide shell 124, or can be mounted to the lower unit 12 by any fastening method, including, screws, clamps, clips or any fastening method sufficient to mount the baffle 110 to the lower unit 12.

The baffle 110 is configured to partially obstruct the side inlet 92 of the discharge mechanism 28. By partially obstructing the side inlet 92 of the discharge mechanism 28, the baffle 110 allows finely shredded blowing wool to enter the side inlet 92 of the discharge mechanism 28 and directs heavy clumps of blowing wool upward past the side inlet 92 of the discharge mechanism 28 to the low speed shredders 24*a* and 24*b* for recycling and further shredding.

In this embodiment, the baffle 110 has a triangular cross-sectional shape. Alternatively, the baffle 110 can have any cross-sectional shape sufficient to allow finely shredded blowing wool to enter the side inlet 92 of the discharge mechanism 28 and to direct heavy clumps of blowing wool past the side inlet 92 of the discharge mechanism 28 to the low speed shredders 24*a* and 324*b* for recycling.

As further shown in FIG. 9, the baffle 110 has a height h which extends to partially obstruct the side inlet 92 of the discharge mechanism 28. In this embodiment, the height h of the baffle 110 extends approximately 20% of the length l of the side inlet 92. Alternatively, the height h of the baffle 110 can extend to any height sufficient to allow finely shredded blowing wool to enter the side inlet 92 of the discharge mechanism 28 and to direct heavy clumps of blowing wool past the side inlet 92 of the discharge mechanism 28 to the low speed shredders 24*a* and 24*b* for recycling.

The principle and mode of operation of this blowing wool machine have been described in its preferred embodiments. However, it should be noted that the blowing wool machine may be practiced otherwise than as specifically illustrated and described without departing from its scope.

What is claimed is:

1. A machine comprising:

a chute having an inlet end, the inlet end configured to receive a bag of compressed blowing wool;

a shredding chamber associated with the chute, the shredding chamber including a plurality of shredders configured to receive the blowing wool exiting the chute and further configured to shred and pick apart the blowing wool and an agitator, the agitator positioned to receive the shredded and picked apart blowing wool from the shredders and further configured to prepare the blowing wool for distribution into an airstream, the plurality of shredders and the agitator configured for rotation, each of the shredders having a plurality of paddle assemblies connected to a shaft; and a discharge mechanism mounted to receive the shredded and picked apart blowing wool from the agitator and further configured to distribute the blowing wool into an airstream;

wherein in operation, the rotational speed of the agitator is higher than the rotational speed of the shredders.

2. The machine of claim 1, wherein the plurality of shredders are configured to rotate at the same speed.

3. The machine of claim 1, wherein the plurality of shredders and the agitator are configured to rotate in the same direction.

4. The machine of claim 3, wherein the plurality of shredders and the agitator are configured to rotate in a counter-clockwise direction.

5. The machine of claim 1, wherein the shredders and the agitator are mounted on rotatable shafts, and wherein the shredder shafts and the agitator shafts are generally parallel to each other.

6. The machine of claim 5, wherein the shredder shafts are substantially physically identical to each other so as to be interchangeable.

7. The machine of claim 5, wherein the shredder shafts are offset from each other in a vertical direction.

8. The machine of claim 1, wherein the shredders rotate at a speed in a range of from about 40 rpm to about 80 rpm.

9. The machine of claim 1, wherein the agitator rotates at a speed in a range of from about 300 rpm to about 500 rpm.

* * * * *